US012753474B2

(12) United States Patent
Park et al.

(10) Patent No.: US 12,753,474 B2
(45) Date of Patent: Oct. 6, 2026

(54) RESETTABLE METALLIC GLASS AND MANUFACTURING METHOD THEREFOR

(71) Applicant: Seoul National University R&DB Foundation, Seoul (KR)

(72) Inventors: Eun Soo Park, Seoul (KR); Geun Hee Yoo, Seoul (KR); Kook Noh Yoon, Seoul (KR); Ji Young Kim, Seoul (KR); Wook Ha Ryu, Seoul (KR)

(73) Assignee: Seoul National University R&DB Foundation, Seoul (KR)

( * ) Notice: Subject to any disclaimer, the term of this patent is extended or adjusted under 35 U.S.C. 154(b) by 95 days.

(21) Appl. No.: 17/486,987

(22) Filed: Sep. 28, 2021

(65) Prior Publication Data

US 2022/0098713 A1 Mar. 31, 2022

(30) Foreign Application Priority Data

Sep. 28, 2020 (KR) ..... 10-2020-0125494

(51) Int. Cl.
*C22C 45/10* (2006.01)
*C22F 1/18* (2006.01)

(52) U.S. Cl.
CPC ..... *C22C 45/10* (2013.01); *C22F 1/183* (2013.01); *C22F 1/186* (2013.01); *C22C 2200/02* (2013.01)

(58) Field of Classification Search
None
See application file for complete search history.

(56) References Cited

U.S. PATENT DOCUMENTS 5,735,975 A * 4/1998 Lin ..... C22C 45/10 148/403

FOREIGN PATENT DOCUMENTS

| | | | | |
|---|---|---|---|---|
| CN | 101195874 A | * | 6/2008 | |
| CN | 102268616 A | * | 12/2011 | |
| CN | 103305778 A | * | 9/2013 | |
| CN | 103334066 A | * | 10/2013 | |
| CN | 108251767 A | * | 7/2018 | ..... C22C 45/04 |
| JP | 2005220406 A | * | 8/2005 | |
| KR | 10-2013-0035726 | | 4/2013 | |

(Continued)

OTHER PUBLICATIONS

English language machine translation of KR 20190041589 to Park. Generated Jul. 26, 2023. (Year: 2023).*

(Continued)

*Primary Examiner* — Brian D Walck

(74) *Attorney, Agent, or Firm* — LEX IP MEISTER, PLLC

(57) ABSTRACT

Disclosed are a resettable metallic glass and a manufacturing method therefor. The resettable metallic glass may include: (1) an element group TM consisting of group IV transition elements; (2) an element group E having a negative (−) enthalpy of mixing with group IV transition elements and including a eutectic reaction of a large temperature difference; (3) an element group PN having a positive (+) enthalpy of mixing with the element group TM and a negative (−) enthalpy of mixing with the element group E to form both a TM-E cluster resetting core and an E-PN cluster resetting core or, on the contrary, an element group NP having a negative (−) enthalpy of mixing with the element group TM and a positive (+) enthalpy of mixing with the element group E to form both a TM-E cluster resetting core and a TM-NP cluster resetting core.

5 Claims, 11 Drawing Sheets

Non-uniform strain formed toward periphery of internal liquid-like region due to relative contraction/expansion

(56) References Cited

FOREIGN PATENT DOCUMENTS

| | | |
|---|---|---|
| KR | 10-2017-0090246 | 8/2017 |
| KR | 10-2018-0023645 | 3/2018 |
| KR | 10-2018-0110617 | 10/2018 |
| KR | 10-2019-0017159 | 2/2019 |
| KR | 10-2019-0041589 | 4/2019 |
| KR | 10-2019-0109004 | 9/2019 |
| KR | 10-2020-0089487 | 7/2020 |
| KR | 10-2020-0093913 | 8/2020 |

OTHER PUBLICATIONS

English language machine translation of KR 20200093913 to Park. Generated Jul. 26, 2023. (Year: 2023).*
English language machine translation of KR 20180023645 to Kim. Generated Jul. 26, 2023. (Year: 2023).*
Sanders, Robert E. "Aluminum and Aluminum Alloys." Kirk-Othmer Encyclopedia of Chemical Technology. vol. 2. pp. 279-343. Posted online Nov. 15, 2002. (Year: 2002).*
English language machine translation of CN-108251767-A. 2024. (Year: 2024).*
Murray et al. "Preparation and Characterization of Pure Metals." ASM Handbook, vol. 2: Properties and Selection: Nonferrous Alloys and Special-Purpose Materials. ASM Handbook Committee, p. 1093-1097. 1990. (Year: 1990).*
English language translation of CN-103334066-A. Generated 2024. (Year: 2024).*
English language translation of CN-103305778-A. Generated 2024. (Year: 2024).*
Mattern et al. "Structural and magnetic nanoclusters in Cu50Zr50-xGdx (x=5 at.%) metallic glasses." Acta Materialia 60 (2012) 1946-1956. (Year: 2012).*
Zhang et al. "Cerium addition on pitting corrosion of (Cu50Zr50) 100-2xCe2x (x=0, 1, 2 and 3) metallic glasses in seawater." Journal of Rare Earths, vol. 33, No. 1, Jan. 2015, p. 102-106. (Year: 2015).*
English language machine translation of CN-102268616-A. Generated Jan. 16, 2025. (Year: 2025).*
English language machine translation of JP-2005220406-A. Generated Jan. 16, 2025. (Year: 2025).*
English language machine translation of CN-101195874-A. Generated Feb. 24, 2026. (Year: 2026).*
Liou et al. "Magnetic properties and hyperfine interactions of amorphous Fe—Hf alloys." Journal of Applied Physics, vol. 57, pp. 3536-3538. Apr. 15, 1985. (Year: 1985).*
Iwashita et al. "TDPAC study of mechanically alloyed amorphous and intermetallic Fe—Hf alloys." Hyperfine Interactions, vol. 78, pp. 527-534. 1993. (Year: 1993).*
Li et al. "The Preparation of High-Purity Iron (99.987%) Employing a Process of Direct Reduction-Melting Separation-Slag Refining." Materials, vol. 13, pp. 1-15. Apr. 14, 2020. (Year: 2020).*
Levy et al. "Hafnium binary alloys from experiments and first principles." Acta Materialia 58 (2010) 2887-2897. Feb. 20, 2010. (Year: 2010).*

* cited by examiner

Strong glass

Fragile glass

Non-uniform strain formed toward periphery of internal liquid-like region due to relative contraction/expansion

RESETTABLE METALLIC GLASS AND MANUFACTURING METHOD THEREFOR

CROSS REFERENCE TO RELATED APPLICATION

This application claims priority from Korean Patent Application No. 10-2020-0125494, filed on Sep. 28, 2020, which is hereby incorporated by reference for all purposes as if fully set forth herein.

BACKGROUND OF THE INVENTION

1. Field of the Invention

The present disclosure relates to a resettable metallic glass (MG) and a manufacturing method therefor, wherein by means of the configuration of an amorphous structure having multiple resetting cores in an atomic-scale cluster form through the control of constituent elements having maximized complexity in thermodynamic enthalpy of mixing, the metallic glass has a maximum change in local stress distribution by even a small external stimulus, facilitating the recovery to the original microstructure through dilatation at the time of deformation not exceeding the critical deformation, leading to maximized resettability.

2. Description of the Prior Art

Metallic glasses have excellent mechanical properties, which are distinguished from crystalline alloys, due to disordered atomic arrangements such as a liquid-like structure. Zr-, Ti-, and Cu-based bulk metallic glasses with high glass forming ability are known to have a large fracture strength of about 2 GPa and an elastic limit of about 1.5% or more and thus are new materials that are highly applicable as high-quality structural materials. Especially, the use of bulk metallic glasses can obtain ultra-high strength materials as well as achieve lightweight products due to high specific strength, and the bulk metallic glasses are composed of uniform microstructures without grain boundaries and the like and thus have high corrosion resistance and wear resistance. Metallic glasses generally require high raw material costs since they are manufactured using high-grade elements, but can lower manufacturing costs due to excellent molding properties similar to those of plastics, and it is therefore sought that various kinds of metallic glasses are utilized for part materials with complex shapes in which repeated deformation occurs continuously. The manufacturing technology for bulk metallic glasses having such characteristics has a great ripple effect on related industries, such as automobiles, nuclear power fields, aerospace, military industries, and nanodevices (MEMS).

However, typical metallic glasses are known to have little ductility at a temperature not higher than the glass transition temperature ($T_g$), and the reason is that the plastic deformation procedure of metallic glasses results from the formation and propagation of shear bands and is easily transferred to cracks through local stress concentration. Therefore, research and development on a metallic glass matrix composite material mixed with a crystalline second phase so as to prevent the formation and propagation of shear bands to control the sudden fracture of metallic glasses has been received attention. Research has been actively conducted to improve the ductility of metallic glasses through the efforts of controlling the characteristics of crystalline second phases of various kinds and adding the crystalline second phases or controlling the shapes of crystalline second phases with various shapes, such as particles, fibers, and plates, and adding the crystalline second phases, like (a) hard ceramic particles, such as $Al_2O_3$ and SiC, (b) soft metal particles, such as Ta, Mo, W, and β-dendrite extruded during solidification of alloys, and (c) transformable second phases, such as shape memory alloy phases, which are composite materials having metallic glasses as matrixes. Through recent experimental results that a composite material with a small spacing between crystalline second phase particles is advantageous in preventing the sudden propagation of shear bands and that multiple shear bands are formed in the amorphous matrix-crystalline second phase interface and thus are effective in improving elongation, it can be seen that the structural control of composite materials also plays an important role in improving ductility of metallic glasses.

Meanwhile, it has been known that compared with traditional plastic deformation processes, such as rolling and extrusion, well-known severe plastic deformation processes of materials, such as equal channel angular pressing (ECAP), high pressure torsion (HPT), and accumulative roll-bonding (ARB), induce tens or hundreds of times plastic deformation in crystalline materials to reduce grain sizes to at least several tens of nanometers, and as a result, the strength of the materials is greatly improved and, in some alloys, the toughness of materials is also improved. Especially, as for the high pressure torsion, while a pressure of several GPa is applied in the longitudinal direction to a material that is prepared in the form of a thin disk, the material is subjected to torsional deformation through the rotation of an anvil to generate shear stress, and therefore the severe plastic deformation can be given to various kinds of single metal and alloy materials and even brittle ceramic materials. Recently, the results of studying the changes in mechanical/thermal properties of metallic glasses due to plastic deformation by high-pressure torsional deformation of brittle metallic glasses have begun to receive attention, and the reason is that general crystalline materials are reinforced through grain refinement by plastic deformation, whereas metallic glasses showed structural recovery in which free volumes and shear transformation zones increased. Research is also being actively conducted on structural recovery through the local stress-induced dilatation by inducing stress changes inside the amorphous structure through the application of thermo-cycle as a post-treatment in which an external stimulus is applied. Especially, such structural recovery noticeably reduces the sudden formation and propagation behavior of shear bands of metallic glasses through stress dissipation by the activation of soft spots, and in some alloys, elongation was observed in the tensile test results. That is, the application of external energy, such as severe plastic deformation/thermo-cycle of metallic glasses, induced structural recovery of amorphous materials, thereby improving the toughness of alloys.

However, the prior art as above is associated with a composite form in which second phase particles are formed in the amorphous matrix, and thus the properties other than elongation are markedly degraded due to the formation of an interface. Alternatively, the prior art is associated with a technology in which conventionally metallic glasses were simply developed by giving plastic properties to materials through post-treatment after the formation of an amorphous structure, and thus the metallic glasses had a restriction in maximizing sustainability in the use environment. Therefore, there is an urgent need to develop new alloy improved in such properties.

PRIOR ART DOCUMENTS

Patent Documents (Patent Document 1) U.S. Pat. No. 6,623,566 B1, Method of selection of alloy compositions for bulk metallic glasses (Patent Document 2) U.S. Pat. No. 6,669,793 B2, Microstructure controlled shear band pattern formation in ductile metal/bulk metallic glass matrix composites prepared by SLR processing (Patent Document 3) Korean Patent No. KR 10-1427026, Method for severe plastic deformation of metal tube materials and apparatus therefor

SUMMARY OF THE INVENTION

The present disclosure has been made in order to solve the above-mentioned problems in the prior art, and an aspect of the present disclosure is to provide a metallic glass and a manufacturing method therefor, wherein by means of the development of a metallic glass, which is a single amorphous phase without second phase precipitation and which has multiple atomic-scale resetting cores through the control of constituent elements having maximized complexity in thermodynamic enthalpy of mixing, the metallic glass has a maximum change in local stress distribution by even a small external stimulus, facilitating the structural recovery through local stress-induced dilation, leading to maximized resettability.

In accordance with an aspect of the present disclosure, there is provided a metallic glass having excellent resettability by having multiple atomic-scale resetting cores through the control of constituent elements having maximized complexity in enthalpy of mixing, wherein the metallic glass may include: (1) an element group TM consisting of Ti, Zr, and Hf, which are high-melting point group IV transition elements; (2) an element group E corresponding to group III transition elements having a negative (−) enthalpy of mixing with group IV transition elements and including an eutectic reaction of a large temperature difference; (3) an element group PN having a positive (+) enthalpy of mixing with the element group TM and a negative (−) enthalpy of mixing with the element group E to form both a TM-E cluster resetting core and an E-PN cluster resetting core or, on the contrary, an element group NP having a negative (−) enthalpy of mixing with the element group TM and a positive (+) enthalpy of mixing with the element group E to form both a TM-E cluster resetting core and a TM-NP cluster resetting core. Furthermore, the metallic glass may further include (4) an element group P having a positive (+) enthalpy of mixing with both the element group TM and the element group E to form both a TM-E cluster resetting core and a P-centered cluster resetting core, or an element group N having a negative (−) enthalpy of mixing with both the element group TM and the element group E to form both a TM-E-N cluster resetting core and a TM-N cluster resetting core. Especially, a metallic glass having such a complex enthalpy of mixing may contain multiple atomic-scale resetting cores in an amorphous matrix and thus has a maximum change in local stress distribution by even a small external stimulus, thereby facilitating the recovery to the original structure through dilatation in the deformation not exceeding the critical deformation, leading to maximized resettability.

Furthermore, there is provided a method for manufacturing a resettable metallic glass, the method including:

preparing parent alloying elements for forming multiple resetting cores;

melting the prepared parent alloying elements into a homogeneous liquid phase and then amorphizing the liquid phase through rapid cooling; and optimizing the resettability of the alloy through two-stage heat treatment.

The two-stage heat treatment includes a relaxation treatment (RX-treatment) as a first stage; and a resetting treatment (RS-treatment) as a second stage. When the alloy of the present disclosure is subjected to two-stage heat treatment through the RX-treatment and RS-treatment, the amorphous structure can be effectively controlled to maximize the resettability.

The above-described resettable metallic glass of the present disclosure, even when locally deformed in a use environment not exceeding the critical stress, can be recovered to the original characteristics by a resetting treatment, thereby promoting increased lifespan of materials.

Especially, the resettable metallic glass of the present disclosure has an amorphous structure with optimum resettability through the RX-treatment followed by the RS-treatment, thereby repeatedly enabling the recovery to the original amorphous structure while preventing the deteriorations in properties due to the non-uniform distribution of structural defects that may be present in the amorphous matrix, and thus can promote both strength resetting and long lifespan.

The resettable metallic glass according to the present disclosure can be utilized as raw materials, substituting for existing materials, for complicatedly shaped parts (bolts, nuts, hinges, spring, bearing, driving shafts, gears, etc.) in which repeated deformation continuously occurs. Furthermore, the source materials and manufacturing technology of metallic glasses having these characteristics have a great ripple effect on related industries, such as automobiles, nuclear power fields, aerospace, military industries, nanodevices (MEMS), and the like.

BRIEF DESCRIPTION OF THE DRAWINGS

FIG. 1A and FIG. 1B depict the classification of typical metallic glasses according to structure, wherein FIG. 1A shows strong glass having a dense amorphous structure and FIG. 1B shows fragile glass having a loose amorphous structure.

DETAILED DESCRIPTION OF THE EXEMPLARY EMBODIMENTS

Figure 1A:
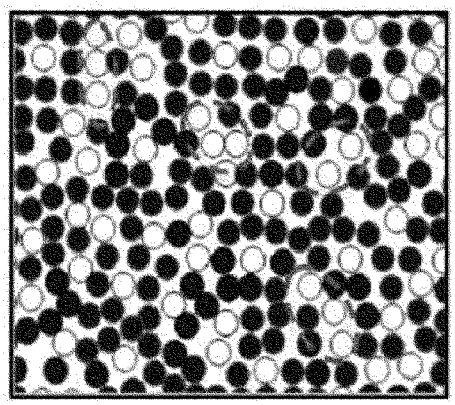

Exemplary embodiments of the present disclosure will be described with reference to the accompanying drawings such that those skilled in the art could easily implement the exemplary embodiments described herein. The present disclosure may be embodied in various different forms and is not limited to exemplary embodiments set forth herein. In the drawings, parts not relating to the description are omitted in order to clearly describe the present disclosure, and throughout the specification, like reference numerals refer to like elements throughout. In addition, the detailed description of the widely known technologies will be omitted. Throughout the specification, when a part "includes" or "comprises" an element, unless there is a particular description contrary thereto, the part can further include other elements, not excluding the other elements.

The present disclosure relates to a resettable metallic glass and a manufacturing method therefor, wherein by means of the configuration of an amorphous structure having multiple resetting cores in an atomic-scale cluster form through the control of constituent elements having maximized complexity in thermodynamic enthalpy of mixing, the metallic glass has a maximum change in local stress distribution by even a small external stimulus, facilitating the recovery to the original microstructure through local stress-induced dilatation, leading to maximized resettability.

Such resettability is not excellently expressed in all metallic glasses, and can be maximized when multiple resetting cores in an atomic-scale cluster form within the amorphous structure make synergy through interactions thereof. In the present disclosure, elements having complex thermodynamic relationships were added to allow the amorphous structure to contain multiple resetting cores in various atomic-scale cluster forms, thereby maximizing the complexity of the structure. A resettable metallic glass therefor may be composed of: (1) an element group TM consisting of group IV transition elements; (2) an element group E having a negative (−) enthalpy of mixing with group IV transition elements and including a eutectic reaction of a large temperature difference; (3) an element group PN having a positive (+) enthalpy of mixing with the element group TM and a negative (−) enthalpy of mixing with the element group E to form both a TM-E cluster resetting core and an E-PN cluster resetting core or, on the contrary, an element group NP having a negative (−) enthalpy of mixing with the element group TM and a positive (+) enthalpy of mixing with the element group E to form both a TM-E cluster resetting core and a TM-NP cluster resetting core. Furthermore, the metallic glass may further include (4) an element group P having a positive (+) enthalpy of mixing with both the element group TM and the element group E to form both a TM-E cluster resetting core and a P-centered cluster resetting core, or an element group N having a negative (−) enthalpy of mixing with both the element group TM and the element group E to form both a TM-E-N cluster resetting core and a TM-N cluster resetting core.

Hereinafter, the above-described resettable metallic glass and method for manufacturing the same will be described in detail step by step.

Structure of Metallic Glass with Improved Resettability

Figure 1B:
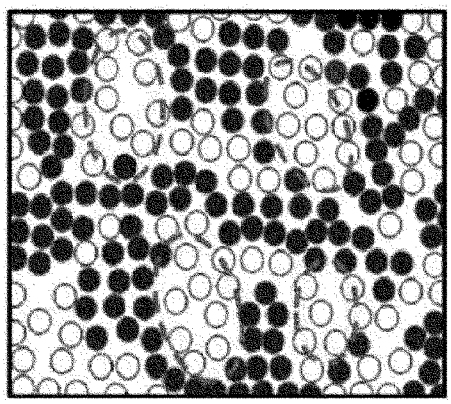
Figure 2:
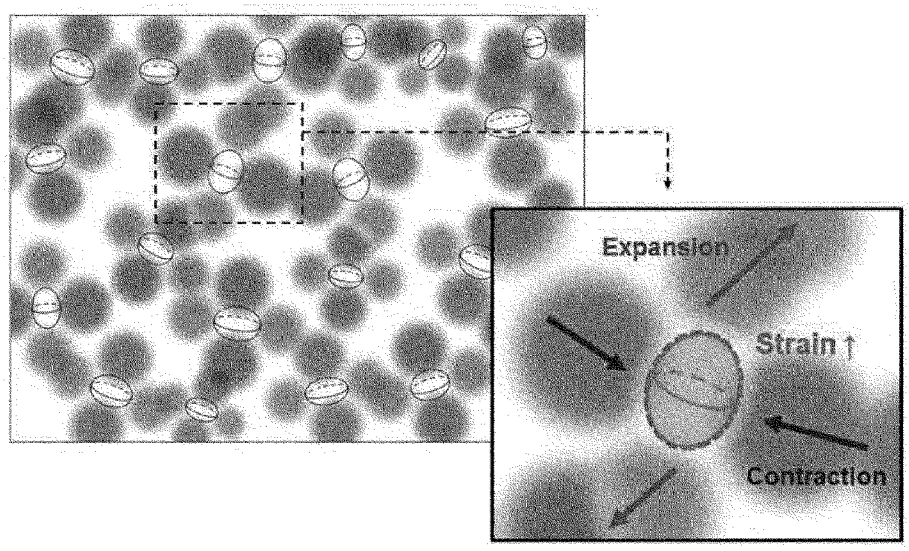
FIG. 2 shows a change in the local stress relationship when an external stimulus (mechanical stress, thermo-cycle, electrical pulse, etc.) is applied to an amorphous structure.

Metallic glass generally refers to one having a disordered atomic arrangement without any special crystallographically ordered structure, obtained by melting and fast solidification metal materials. In such a case, both a solid-like region as a dense disordered structure and a liquid-like region as a loose disordered structure are present in the metallic glass. The solid-like region has a dense packing structure in which atoms are present more densely than the liquid-like region serving as a soft spot, and exhibits a more stable amorphous structure. FIG. 1A and FIG. 1B depict the classification of typical metallic glasses according to the structure, wherein FIG. 1A shows strong glass having a relatively dense amorphous structure and FIG. 1B shows fragile glass having a relatively loose amorphous structure. The atoms marked in black denote solid-like regions that form a dense packed structure in the metallic glass structure, and the atoms marked in white denote liquid-like regions. The strong glass has very few liquid-like regions in the amorphous structure, and thus has high structural stability. However, the fragile glass has relatively more liquid-like regions, and thus may be determined to be high in structural instability. FIG. 2 shows a change in local stress relationship when an external stimulus (mechanical stress, thermo-cycle, electrical pulse, etc.) is applied to the amorphous structure. As can be seen from the drawing, the dense solid-like regions and the loose liquid-like regions form a locally different deformation fields in the disordered structure while conducting different extents of contraction and expansion from each other, thereby facilitating the recovery to the original microstructure through the local stress-induced dilatation throughout the amorphous structure, leading to the expression of resettability. It can be therefore inferred that higher structural complexity within the amorphous structure is more advantageous in the improvement of resettability.

Figure 3:
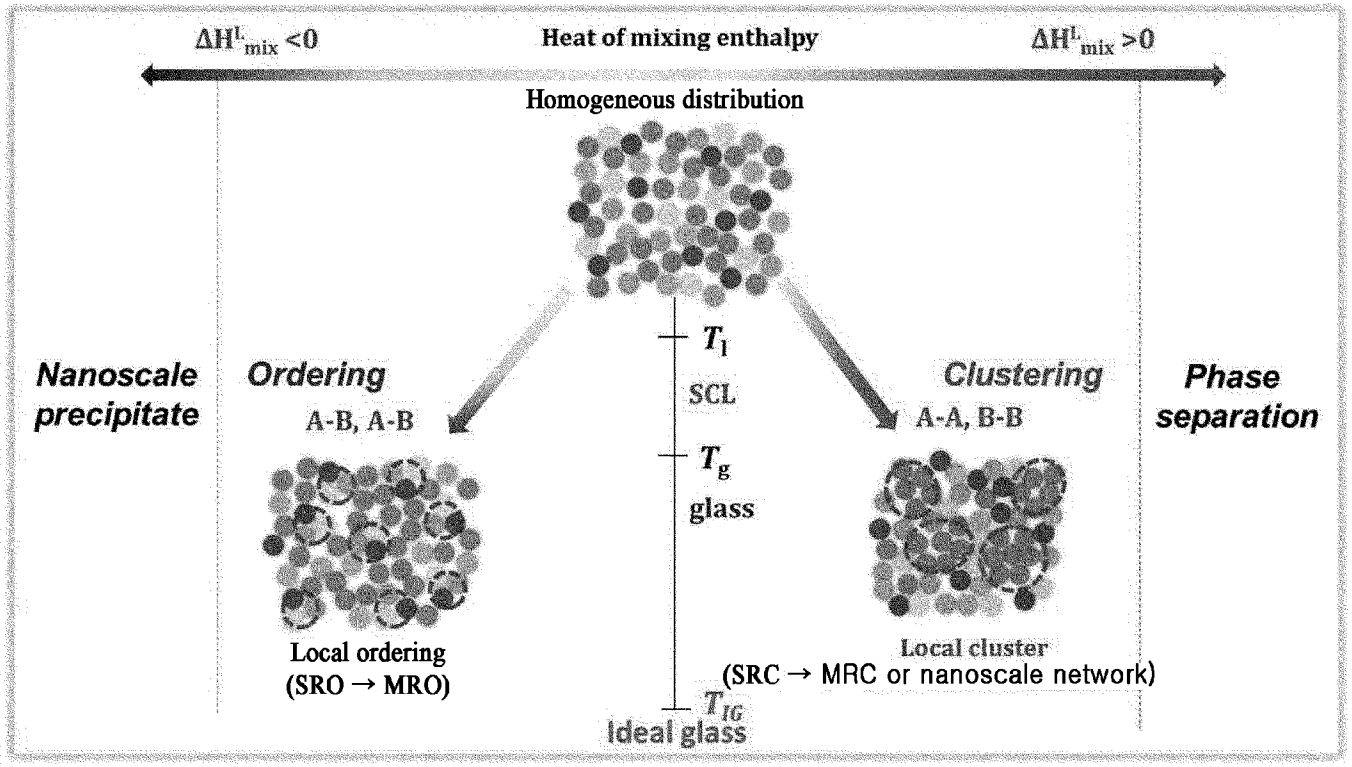
FIG. 3 is a schematic diagram showing the criteria for forming an atomic-scale cluster according to the enthalpy of mixing of constituent elements inside the disordered metallic glass.
Figure 4:
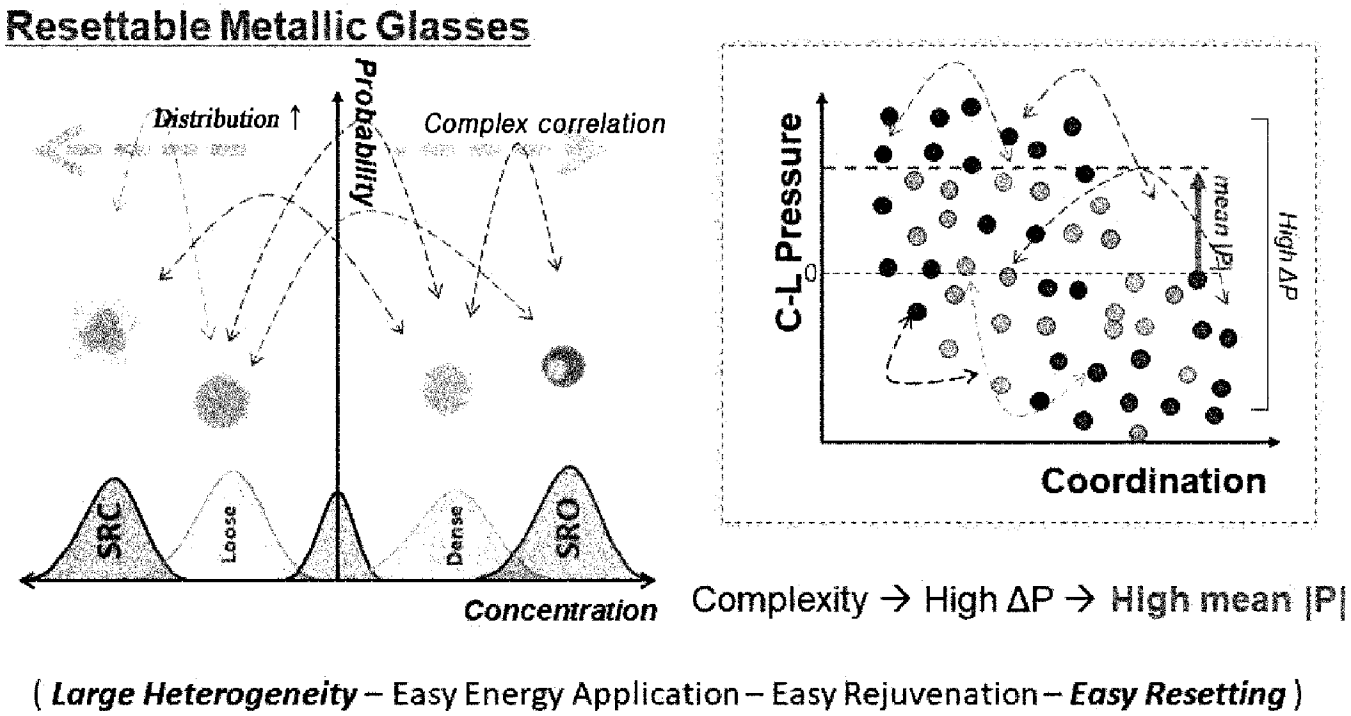
FIG. 4 is a schematic diagram showing the correlation between structural complexity and resettability in a resettable metallic glass.
Figure 5A:
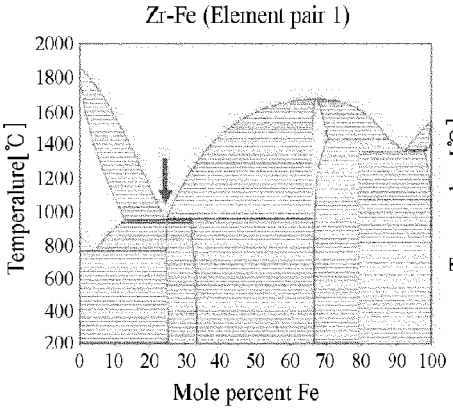
FIG. 5A to FIG. 5E show the results of drawing binary phase diagrams between Zr, which is a representative element of the element group TM, and Fe (FIG. 5A), Co (FIG. 5B), Ni (FIG. 5C), Cu (FIG. 5D), and Zn (FIG. 5E), which constitute the element group E.
Figure 5B:
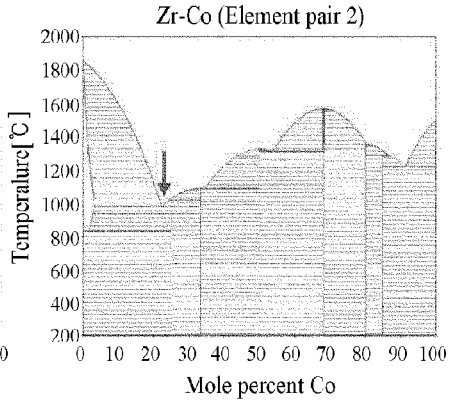
Figure 5C:
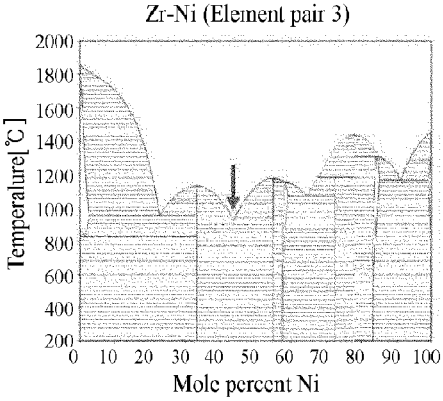
Figure 5D:
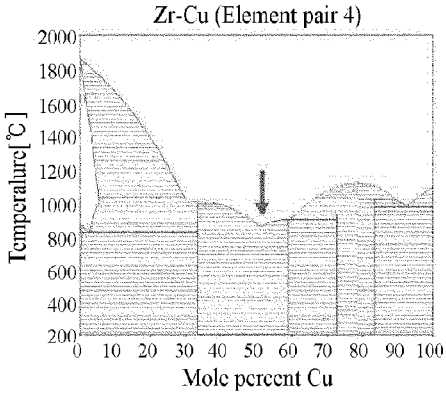
Figure 5E:
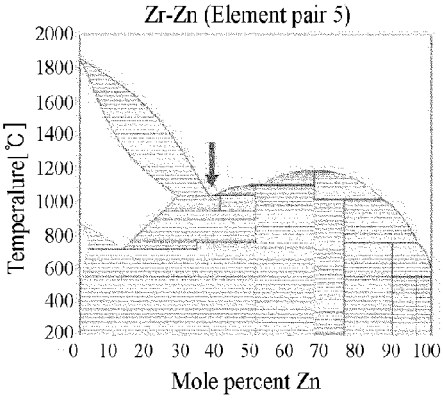

Metallic glasses are generally easy to think of as being completely disordered, but atomic-scale clusters are formed within the metallic glasses by a short-range ordered structure due to a local attractive force or by a repulsive force between elements. FIG. 3 is a schematic diagram showing the criteria for forming atomic-scale clusters according to the enthalpy of mixing ($\Delta H_{mix}$) of constituent elements inside the disordered metallic glass. As can be seen from the drawing, general metallic glasses are ideal to have a completely disordered structure as shown in the middle part of the drawing, but the metallic glasses structurally include atomic-scale clusters due to the enthalpy of mixing between elements during solidification, resulting in the precipitation of second phases, or even if not phase separation, a wide structural difference. First, when all of elements having a positive (+) enthalpy of mixing are alloyed, the corresponding atoms exert a repulsive force therebetween, locally, and the separated elements are gathered, thereby forming atomic-scale clusters. On the contrary, when all of elements having a negative (−) enthalpy of mixing are alloyed, atoms are locally combined to have a short-range ordered structure (SRO), which is also included in the principle of cluster formation. Such a cluster is one which is formed by gathering of several to several tens of atoms, and is difficult to define as a new phase. When the cluster becomes larger than a predetermined size range, the growth of the cluster accelerates to the periphery thereof, resulting in a stress environment, such as a composite structure including a second phase with a clear boundary with the matrix metallic glass. Therefore, the metallic glass structure may have a wide structural variation, including not only solid-like regions and liquid-like regions, but also an atomic-scale short-range ordered structure and an atomic-scale cluster region according to the element composition. However, these atomic-scale clusters generally act as a factor that inhibit the glass-forming ability and, therefore, in most cases, leading clusters are present in the glass-formed alloys, and there is no report of developing metallic glasses having a special amorphous structure by intentionally controlling the formation of a large number of atomic-scale clusters. However, it has been reported through a recent experimental approach that when an undercooled melt is in an optimal state of being frustrated without crystallization due to the activation of multiple clusters, a unique amorphous structure in which all clusters are contained with similar fraction, called an ideal glass, as shown in the lower part of FIG. 3, can be obtained in an ideal condition. Especially, the increase in such structural diversity increases the local pressure between multiple resetting clusters as shown in FIG. 4, and thus the application of the above-described external stimulus (mechanical stress, thermo-cycle, electric pulse, etc.) increases the heterogeneity of local stress to locally form extremely different deformation fields, thereby maximizing the recovery to the original microstructure through the stress-induced dilatation throughout the amorphous structure, leading to the improvement in resettability. Based on the above-described matter, a resettable metallic glass having multiple resetting cores in an atomic-scale cluster form through the control of constituent elements having maximized complexity in the thermodynamic enthalpy of mixing is to be designed in the present study.

As described above, in order to design metallic glasses having multiple atomic-scale cluster resetting cores, an element group TM consisting of group IV transition metals having a high melting point was defined as a main constituent element. The element group TM is an element group including Ti, Zr, and Hf, wherein the respective elements have a melting point of 1500° C. or higher and a large atomic radius of about 145 pm or more. Physical properties of the elements constituting the element group TM are shown in detail in Table 1 below.

TABLE 1

| Classification | Element | Atomic radius (pm) | Melting point (° C.) |
|---|---|---|---|
| Element 1 | Ti | 147 | 1668 |
| Element 2 | Zr | 160 | 1855 |
| Element 3 | Hf | 159 | 2233 |

First, a metallic glass needs to be designed to have a dense amorphous structure with high liquid-phase stability in order to stably maintain various atomic-scale cluster resetting cores in the matrix. To this end, in the present disclosure, an element group E consisting of group III transition elements Fe, Co, Ni, Cu, and Zn, was defined, wherein the elements are alloying elements having a large negative enthalpy of mixing of −20 J/mol or less with the element group TM and inducing a eutectic reaction of a large temperature difference when alloyed.

In order to investigate whether the respective elements constituting the element group TM and the elements constituting the element group E actually induce a eutectic reaction, each binary alloy phase diagram was drawn using CALPHAD. FIG. 5A to FIG. 5E shows the results of drawing binary phase diagrams between Zr, which is a representative element of the element group TM, and Fe (FIG. 5A), Co (FIG. 5B), Ni (FIG. 5C), Cu (FIG. 5D), and Zn (FIG. 5E), which constitute the element group E. In the present disclosure, the phase diagrams were drawn by utilizing the Thermo-Calc. software, and calculations were made based on the SSOL6 database, which shows the relationship with solid-solution states most favorably. Unless otherwise specified herein, all thermodynamic calculations were considered to be performed under the same conditions.

TABLE 2

| Classification | Main element (TM) | Element (E) | Eutectic temperature (° C.) | Eutectic composition (at. %) | Maximum melting temperature (° C.) | Maximum melting composition (at. %) |
|---|---|---|---|---|---|---|
| Element pair 1 | Zr | Fe | 946 | 24.3 | 1677 | 67.1 |
| Element pair 2 | Zr | Co | 979 | 22.0 | 1567 | 67.6 |
| Element pair 3 | Zr | Ni | 927 | 23.5 | 1442 | 77.8 |
| Element pair 4 | Zr | Cu | 1034 | 37.1 | 1193 | 66.6 |
| Element pair 5 | Zr | Zn | 863 | 50.8 | 1119 | 78.8 |
| Element pair 6 | Ti | Cu | 869 | 76.7 | 1080 | 100 |
| Element pair 7 | Hf | Cu | 955 | 64.8 | 1126 | 78.4 |

Table 2 shows the summary of characteristics of the eutectic reactions of the constituent elements of the element group TM and the constituent elements of the element group E. As for the results for Element pairs 1 to 5, Zr representing the element group TM was fixed as a main element while the element group E was varied. As can be seen from FIG. 5A to FIG. 5E and Table 2, each element pair of the present disclosure had a deep eutectic reaction indicating the stability of the constituent liquid phase and had a eutectic reaction at a temperature of 1034° C. or lower. Such a temperature was lower by at least 800° C. considering the melting point of Zr is 1855° C., and corresponded to a low percentage, around 60%, of the melting point of the main element, indicating the formation of a stable liquid-phase. It can be therefore identified that the very high stability of a liquid phase can be maintained in a composition region supposed for Zr, the representative element of the element group TM, and all the constituent elements of the element group E.

Figure 6A:
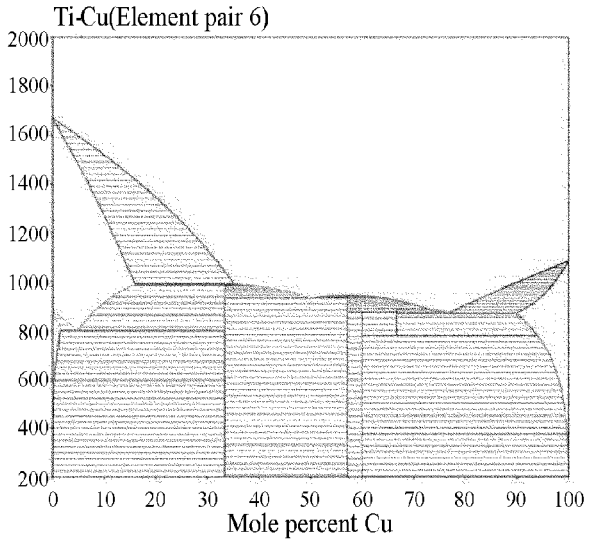
FIG. 6A and FIG. 6B show the results of drawing binary phase diagrams between Cu, which is a representative element of the element group E, and Ti (FIG. 6A) and Hf (FIG. 6B) of the element group TM.
Figure 6B:
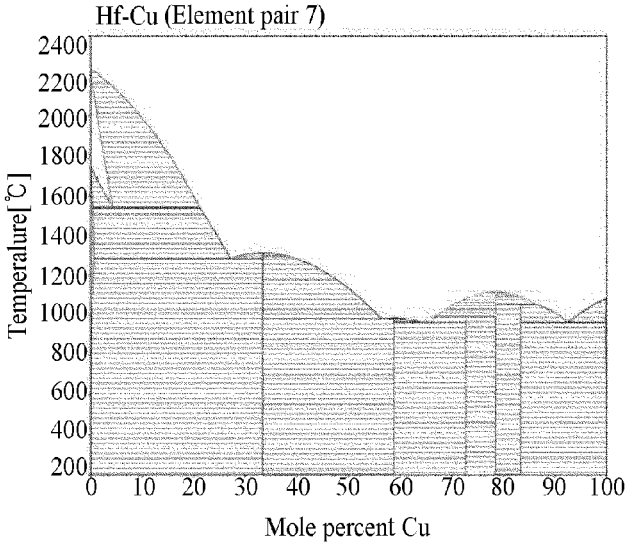

FIG. 6A and FIG. 6B shows the results of drawing binary phase diagrams between Cu, which is a representative element of the element group E, and Ti (FIG. 6A) and Hf (FIG. 6B) of the element group TM. As can be seen from the drawing, the two element pairs also had a deep eutectic reaction. Additionally, as a result of drawing the phase diagrams of alloying of each constituent element of the element group TM and each constituent element of the element group E by the same method, all the element pairs had a deep eutectic reaction.

As described above, limited composition range with high glass forming ability can be determined by the composition near the eutectic point where the stability of the liquid phase increases during solidification. However, rapid cooling is utilized for the manufacture of metallic glasses, and thus the molten liquid phase undergoes non-equilibrium solidification instead of undergoing equilibrium solidification as shown in the drawn phase diagram. Since non-equilibrium solidification usually begins at the point allowing the maximum solid phase stability (peak point), it is preferable to avoid the conditions for the formation of stable intermetallic compounds, which have a melting point greater than that of a pure element. Therefore, when the composition range is defined from Table 2 on the basis of the aforementioned matter, the content of the element group E is preferably within 66.6% in the alloying of the element group TM and the element group E.

Meanwhile, when the composition is too close to the element group TM, a single-phase crystalline alloy may be easily formed upon solidification at a high melting temperature, and thus it is necessary to lower the liquidus temperature by alloying the element group E at the minimum composition fraction or more. Therefore, as a result of consideration on the basis of the aforementioned matter, the minimum solid solubility of the element group E is preferably at least 15 at. %. For example, considering the Ti—Cu binary alloy diagram of FIG. 6A, the liquidus temperature decreases to 1500° C. or lower when Cu is dissolved at 15 at. % or more. This temperature corresponds to 80% or less of the original melting point of the Ti alloy, indicating sufficiently high liquid-phase stability.

Designing of Resettable Metallic Glasses

In the present step, in addition to the composition of the structurally stable metallic glass as described above, an alloying element for multiple atomic-scale cluster resetting cores in the amorphous structure is defined. For the multiple atomic-scale cluster resetting cores as a unique amorphous structure, artificial manipulation needs to be made such that constituent elements have a complex enthalpy of mixing. In this respect, the resettable metallic glass may contain a cluster-forming element group PN, which has a positive (+) enthalpy of mixing with the aforementioned element group TM and a negative (−) enthalpy of mixing with the element group E or, conversely, a cluster-forming element group NP, which has a negative (−) enthalpy of mixing with the aforementioned element group TM and a positive (+) enthalpy of mixing with the element group E.

Hereinafter, the enthalpy of mixing between the selected alloying elements, excluding the elements constituting the element group TM and the element group E, will be described. Zr was selected and marked as an element representing the element group TM and Cu was selected and marked as an element representing the element group E, but the elements in the same element groups (the element group TM_group IV elements, and the element group E_3d transition metals of the fourth period elements) defined in the present disclosure were identified to have a similar tendency as shown in the previous equilibrium phase diagrams.

TABLE 3

| Classification | Atomic number | Element | $\Delta H_{mix,\ Zr}$ (J/mol) | $\Delta H_{mix,\ Cu}$ (J/mol) |
|---|---|---|---|---|
| Element 4 | 12 | Mg | 6 | −4 |
| Element 5 | 21 | Sc | 4 | −24 |
| Element 6 | 39 | Y | 9 | −22 |
| Element 7 | 57 | La | 13 | −21 |
| Element 8 | 58 | Ce | 12 | −21 |
| Element 9 | 59 | Pr | 10 | −22 |
| Element 10 | 60 | Nd | 10 | −22 |
| Element 11 | 62 | Sm | 9 | −22 |
| Element 12 | 64 | Gd | 9 | −22 |
| Element 13 | 66 | Dy | 8 | −22 |
| Element 14 | 67 | Ho | 9 | −22 |
| Element 15 | 68 | Er | 7 | −23 |

Table 3 shows elements constituting the atomic-scale cluster-forming element group PN having a positive (+) enthalpy of mixing with the element group TM and a negative (−) enthalpy of mixing with the element group E. In such a case, both a TM-E cluster resetting core by the constituent alloying elements having a large negative (−) enthalpy of mixing and an E-PN cluster resetting core by PN, which exerts a repulsive force on TM, and E, on which PN exerts an attractive force, are formed, thereby forming one or more, multiple atomic-scale cluster resetting cores. (The aforementioned TM-E and E-PN refer to a cluster by binding between the element group TM and the element group E and a cluster by binding between the element group E and the element group PN, respectively) However, when the enthalpy of mixing between the alloying element and the element group TM is +15 J/mol or more even though the alloying element satisfies the aforementioned conditions, a two-phase separated microstructure with the interface may be formed due to a strong phase separation tendency, and thus the enthalpy of mixing therebetween is preferably less than +15 J/mol. Furthermore, even when the element group PN is contained in a content of more than 5 at. %, the cluster growth is promoted to form nano-sized or larger two-phase separated regions, resulting in the deterioration in resettability, and thus the content of the element group PN is preferably 5 at. % or less.

TABLE 4

| Classification | Atomic number | Element | $\Delta H_{mix,\ Zr}$ (J/mol) | $\Delta H_{mix,\ Cu}$ (J/mol) |
|---|---|---|---|---|
| Element 16 | 4 | Be | −43 | 1 |
| Element 17 | 5 | B | −71 | 1 |

TABLE 4-continued

| Classification | Atomic number | Element | $\Delta H_{mix,\ Zr}$ (J/mol) | $\Delta H_{mix,\ Cu}$ (J/mol) |
|---|---|---|---|---|
| Element 18 | 13 | Al | −44 | 1 |
| Element 19 | 23 | V | −4 | 5 |
| Element 20 | 25 | Mn | −15 | 4 |
| Element 21 | 31 | Ga | −40 | 1 |
| Element 22 | 47 | Ag | −20 | 2 |
| Element 23 | 49 | In | −25 | 10 |
| Element 24 | 50 | Sn | −43 | 7 |
| Element 25 | 82 | Pb | −33 | 15 |
| Element 26 | 83 | Bi | −40 | 15 |

Table 4 shows elements constituting the atomic-scale cluster-forming element group NP having a negative (−) enthalpy of mixing with the element group TM and a positive (+) enthalpy of mixing with the element group E. In such a case, both a TM-E cluster resetting core by the constituent alloying elements having a large negative (−) enthalpy of mixing and a TM-NP cluster resetting core by NP, which exerts a repulsive force on E, and TM, on which NP exerts an attractive force, are formed, thereby forming one or more, multiple atomic-scale cluster resetting cores. However, when the enthalpy of mixing between the alloying element and the element group E is +15 J/mol or more even though the alloying element satisfies the aforementioned conditions, a two-phase separated microstructure with the interface may be formed due to a strong phase separation tendency, and thus the enthalpy of mixing therebetween is preferably less than +15 J/mol. Furthermore, even when the element group NP is contained in a content of more than 15 at. %, the cluster growth is promoted to form nano-sized or larger two-phase separated regions, resulting in the deterioration in resettability, and thus the content of the element group NP is preferably 15 at. % or less.

In other words, the resettable metallic glass according to the present disclosure may have a composition of [Chemical Formula 1] below.

$$\left[(TM)_{\frac{100-x}{100}}(E)_{\frac{x}{100}}\right]_{100-p-n}(PN)_p(NP)_n \qquad \text{[Chemical Formula 1]}$$

(TM is at least one species of element selected from the element group consisting of Ti, Zr, and Hf;

E is at least one species of element selected from the element group consisting of Fe, Co, Ni, Cu, and Zn;

PN is at least one species of element selected from the element group consisting of Mg, Sc, Y, La, Ce, Pr, Nd, Sm, Gd, Dy, Ho, and Er; and NP is at least one species of element selected from the element group consisting of Be, B, Al, V, Mn, Ga, Ag, In, Sn, Pb, and Bi, wherein $15 \le x \le 66.6$, $0 \le p \le 5$, $0 \le n \le 15$, and $0 < p+n \le 20$ at. %.)

Table 6 below shows the results validating whether alloys of [Chemical Formula 1] can actually configure metallic glasses, through actually manufactured comparative examples and examples. Metallic glasses to be later described were manufactured by preparing parent alloying elements for forming multiple resetting cores; and melting the prepared parent elements into a homogeneous liquid phase and then amorphizing the liquid phase through rapid cooling. In the homogeneous melting, arc-melting was utilized, but the alloy can be manufactured through various commercial casting process, such as induction casting in which parent elements can be melted by an electric field to prepare a homogeneous alloy, or resistance heating which is capable of fine temperature control, as needed. The rapid cooling was performed by pouring a molten metal into a water cooled mold, wherein cooling was performed at a fast cooling rate of at least 10 K/sec. Unless otherwise specified herein, all the metallic glasses were manufactured through the above steps.

TABLE 5

| Classification | Composition (at. %) | Structure |
|---|---|---|
| Alloy 1 | Zr33.3Cu66.6 | Amorphous |
| Alloy 2 | Zr62Cu38 | Amorphous |
| Alloy 3 | Zr85Cu15 | Amorphous |
| Alloy 4 | Zr72Fe28 | Amorphous |
| Alloy 5 | Zr72Co28 | Amorphous |
| Alloy 6 | Zr62Ni38 | Amorphous |
| Alloy 7 | Zr62Zn38 | Amorphous |
| Alloy 8 | Ti44Cu56 | Amorphous |
| Alloy 9 | Hf44Cu56 | Amorphous |
| Alloy 10 | Zr68Cu24Ni8 | Amorphous |
| Alloy 11 | Zr68Cu8Fe8Co8Ni8 | Amorphous |

Figure 7:
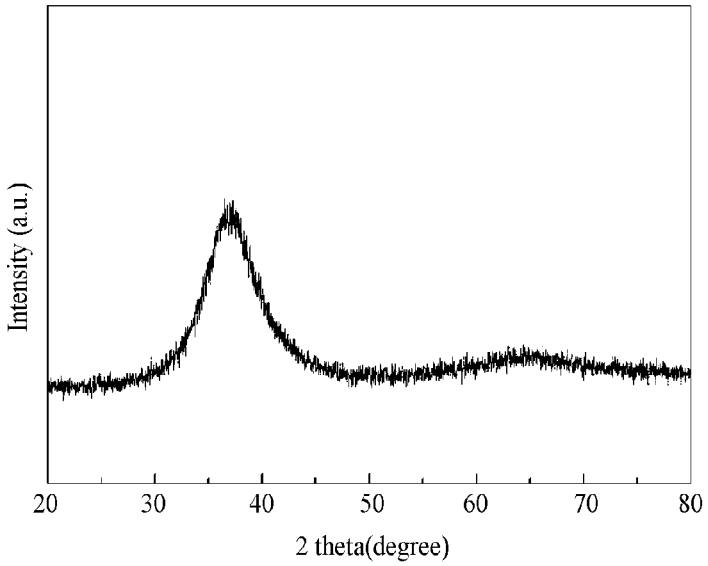
FIG. 7 shows the X-ray diffraction analysis results for Alloy 6 of the present disclosure.

Table 5 shows whether there was amorphous formation in Alloys 1 to 11 composed only of the element group TM and the element group E. In the present disclosure, the checking of amorphous formation was performed through whether the X-ray diffraction analysis result showed a halo pattern appearing in typical metallic glasses. FIG. 7 shows the X-ray diffraction analysis results obtained for Alloy 6, as one example of such analysis. As can be seen from the drawing, a halo pattern appearing in typical metallic glasses was obtained in Alloy 6. First, as can be seen from Alloys 1 to 3 on the table, metallic glasses could be manufactured in a wide stable liquid-phase region predicted through the phase diagram.

Alloys 4 to 9 showed the results of investigating the possibility of amorphous formation while the alloying elements constituting the element group TM and the element group E were varied. As can be seen through the results, metallic glasses were favorably manufactured in all of the alloys configured of elements included in the respective element groups of forming a stable liquid phase, defined in the present disclosure.

As for Alloys 10 and 11, an amorphous structure was favorably formed even when a plurality of elements of the element group E consisting of the third period transition elements are substituted in the composition of the aforementioned Alloy 6. However, it could be identified through high-resolution electron microscopic images that the addition of a plurality of similar third period transition elements in these alloys did not form multiple atomic-scale clusters in the amorphous matrix.

TABLE 6

| Classification | Matrix composition | Added element | Fraction (at. %) | Structure |
|---|---|---|---|---|
| Example 1 | Alloy 6 | Mg | 0.5 | Amorphous |
| Example 2 | Alloy 6 | Mg | 5 | Amorphous |
| Comparative Example 1 | Alloy 6 | Mg | 7.5 | Crystalline |
| Example 3 | Alloy 6 | Sc | 2 | Amorphous |
| Example 4 | Alloy 6 | Y | 2 | Amorphous |
| Example 5 | Alloy 6 | La | 2 | Amorphous |
| Example 6 | Alloy 6 | Ce | 2 | Amorphous |
| Example 7 | Alloy 6 | Pr | 2 | Amorphous |
| Example 8 | Alloy 6 | Nd | 2 | Amorphous |

TABLE 6-continued

| Classification | Matrix composition | Added element | Fraction (at. %) | Structure |
|---|---|---|---|---|
| Example 9 | Alloy 6 | Sm | 2 | Amorphous |
| Example 10 | Alloy 6 | Gd | 2 | Amorphous |
| Example 11 | Alloy 6 | Dy | 2 | Amorphous |
| Example 12 | Alloy 6 | Ho | 2 | Amorphous |
| Example 13 | Alloy 6 | Er | 2 | Amorphous |
| Example 14 | Alloy 6 | La, Ce, Nd, Pr | 2 | Amorphous |

Table 6 shows the results of adding alloying elements of the element group PN on the basis of the composition of Alloy 6. In the alloy of each example, the alloying element was alloyed at 0.5 to 5 at. % relative to the total alloying elements. First, as for Mg representing the element group PN, even when Mg was alloyed up to 5 at. % as in Examples 1 and 2, an amorphous structure was favorably formed. However, when Mg was added at more than 5 at. % as in Comparative Example 1, a cluster between Ni and Mg may promote the nucleation for forming an intermetallic compound, thereby facilitating crystallization. Such a phenomenon did not occur for only Mg, and the same results could be confirmed even when the constituent elements were extended to the other elements of the element group PN as in Examples 3 to 13.

In addition, as can be seen from Example 14 in which the metallic glass was manufactured by adding La, Ce, Nd, and Pr in equal fractions, there was no difference in glass forming ability even when the number of species of alloying elements of the element group PN was increased from one to plurality within the composition range of the present disclosure.

TABLE 7

| Classification | Matrix composition | Added element | Fraction (at. %) | Structure |
|---|---|---|---|---|
| Example 15 | Alloy 6 | Be | 0.5 | Amorphous |
| Example 16 | Alloy 6 | Be | 7.5 | Amorphous |
| Example 17 | Alloy 6 | Be | 15 | Amorphous |
| Comparative Example 2 | Alloy 6 | Be | 17.5 | Crystalline |
| Example 18 | Alloy 6 | Al | 5 | Amorphous |
| Example 19 | Alloy 6 | B | 5 | Amorphous |
| Example 20 | Alloy 6 | V | 5 | Amorphous |
| Example 21 | Alloy 6 | Mn | 5 | Amorphous |
| Example 22 | Alloy 6 | Ga | 5 | Amorphous |
| Example 23 | Alloy 6 | Ag | 5 | Amorphous |
| Example 24 | Alloy 6 | In | 5 | Amorphous |
| Example 25 | Alloy 6 | Sn | 5 | Amorphous |
| Example 26 | Alloy 6 | Pb | 5 | Amorphous |
| Example 27 | Alloy 6 | Bi | 5 | Amorphous |
| Example 28 | Alloy 6 | Al, Be, Ag | 15 | Amorphous |

Table 7 shows the results of adding alloying elements of the element group NP on the basis of the composition of Alloy 6. In the alloy of each example, the alloying element was alloyed at 0.5 to 15 at. % relative to the total alloying elements. First, as for Be representing the element group NP, even when Be was alloyed up to 15 at. % as in Examples 15 to 17, an amorphous structure was favorably formed. However, when Be was added at more than 15 at. % as in Comparative Example 2, a cluster between Ti and Be may promote the nucleation for forming an intermetallic compound, thereby facilitating crystallization. Such a phenomenon did not occur for only Be, and the same results could be confirmed even when the constituent elements were extended to other elements of the element group NP as in Examples 18 to 27.

Figure 8:
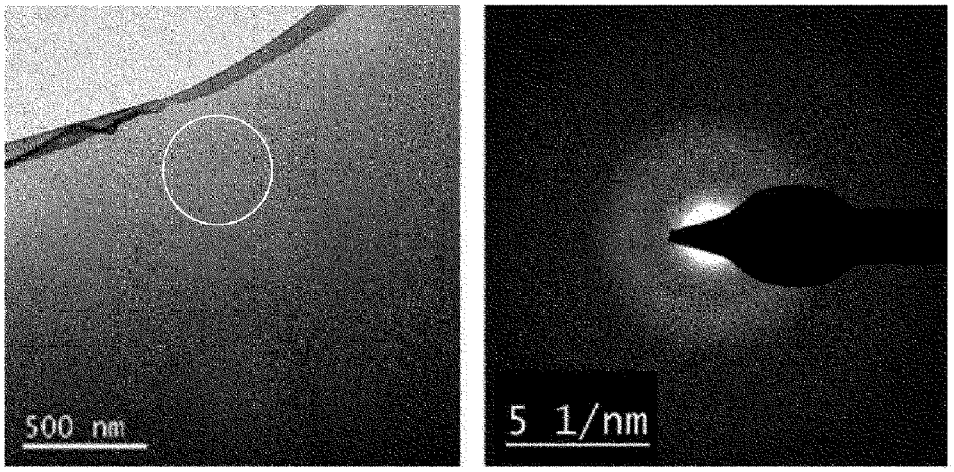
FIG. 8 shows the transmission electron microscopy results for Example 16 of the present disclosure.

In addition, as can be seen from Example 28 in which the metallic glass was manufactured by adding Al, Be, and Ag in equal fractions, there was no difference in amorphous forming behavior even when the number of species of alloying elements of the element group NP was increased from one to plurality within the composition range of the present disclosure. FIG. 8 shows transmission electron microscopic images for Example 28 of the present disclosure. As can be seen from the drawings, even when species of NP elements were added, an amorphous structure was favorably formed without the formation of nanocrystalline phases. However, the metallic glasses having multiple atomic-scale cluster resetting cores of the present disclosure were found to have relatively thick selected area diffraction (SAD) pattern compared with typical metallic glasses, which is caused by the induction of the local composition deviation in the formation of an amorphous structure having multiple atomic-scale cluster resetting cores.

Figure 9A:
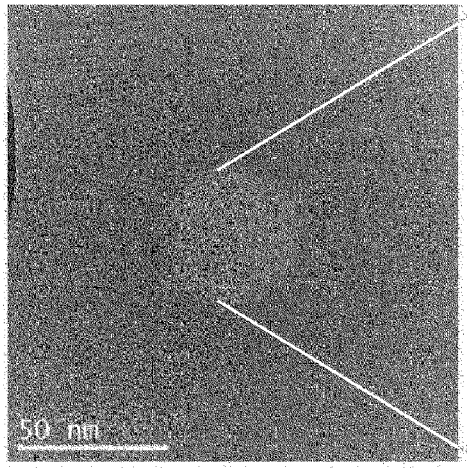
FIG. 9A and FIG. 9B present high-resolution electron microscopic images showing crystallization behavior when high energy beam was intentionally focused on the amorphous structure of Example 16 of the present disclosure.
Figure 9B:
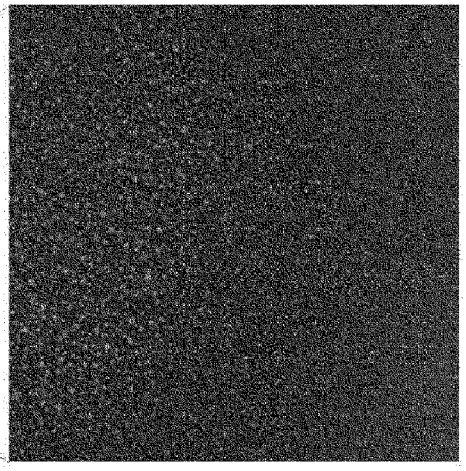

FIG. 9A and FIG. 9B depict high-resolution electron microscopic images showing the crystallization behavior when a high energy beam was intentionally focused on the amorphous structure of Example 28 of the present disclosure. As can be seen from the drawings, a region of the metallic glass of the present disclosure, corresponding to a region on which the high energy beam was not focused, showed a typical high-resolution image (Right region of FIG. 9A). However, as can be seen from FIGS. 9A and 9B, interestingly, all of two or more different types of crystallization behaviors (white spots and minute grey spots in the periphery in FIG. 9B) occurred under the intentionally focused electron beam, in the metallic glass of the present disclosure having multiple atomic-scale cluster resetting cores. As such, it can be identified that the metallic glasses having multiple atomic-scale cluster resetting cores of the present disclosure showed unique microstructure characteristics and responses to external stimuli.

Furthermore, the metallic glass may further include an element group P having a positive (+) enthalpy of mixing with both the element group TM and the element group E to form both a TM-E cluster resetting core and a P-centered cluster resetting core, or an element group N having a negative (−) enthalpy of mixing with both the element group TM and the element group E to form both a TM-E-N cluster resetting core and a TM-N cluster resetting core. (TM-E-N means an atomic cluster containing all the elements constituting the element group TM, the element group E, and the element group N, and similarly, TM-N means a cluster formed between the element group TM and the element group N.) In Table 9, Elements 27 to 38 are elements that constitute the aforementioned element groups P and N. The elements easily form stable precipitation phases when alloyed at excessive amounts, and thus the elements are preferably alloyed at 5 at. % or less relative to the total alloying elements.

TABLE 9

| Classification | Atomic number | Element | $\Delta H_{mix, Zr}$ (J/mol) | $\Delta H_{mix, Cu}$ (J/mol) | Element group | Structure |
|---|---|---|---|---|---|---|
| Element 27 | 41 | Nb | 4 | 3 | P | Amorphous |
| Element 28 | 42 | Mo | 19 | 6 | P | Amorphous |
| Element 29 | 73 | Ta | 2 | 3 | P | Amorphous |
| Element 30 | 74 | W | 22 | 9 | P | Amorphous |
| Element 31 | 6 | C | −131 | −33 | N | Amorphous |
| Element 32 | 7 | N | −233 | −84 | N | Amorphous |
| Element 33 | 14 | Si | −84 | −19 | N | Amorphous |
| Element 34 | 15 | P | −127.5 | −17.5 | N | Amorphous |
| Element 35 | 32 | Ge | −72.5 | −11.5 | N | Amorphous |
| Element 36 | 46 | Pd | −91 | −14 | N | Amorphous |
| Element 37 | 78 | Pt | −100 | −12 | N | Amorphous |
| Element 38 | 79 | Au | −74 | −9 | N | Amorphous |

As described above, the metallic glasses of the present disclosure are advantageous when multiple atomic-scale cluster resetting cores are formed through the maximization of the complexity of the enthalpy of mixing among constituent elements, and therefore, in a case where a metallic glass with maximized complexity of the element composition is configured by containing at least one species of element from each of four or more types of element groups among the element group TM, the element group E, the element group PN, the element group NP, the element group P, and the element group N, all of three or more types of multiple atomic-scale cluster resetting cores are formed, and thus such a case is more preferable.

Optimization of Resettability in Metallic Glasses

The step of optimizing resettability of the manufactured metallic glasses will be described in detail. A resetting process may be performed by additionally applying various types of external energy to materials. Herein, process conditions for optimizing resettability in the metallic glasses were intended to be presented on the basis of the thermocycling process in which energy was repeatedly applied to Example 16 with the temperature changing between cryogenic and high temperatures. The temperature environment change can easily provide complex environments, such as (1) thermal energy application by the temperature change and (2) local mechanical energy application by repetition of dilatation-contraction of bonds between atoms, and thus is advantageous in the resetting process. Apart from these, the application of external energy may be performed by an external force including mechanical, electric, thermal, or magnetic energy, equivalent to the aforementioned thermocycle conditions.

In general, the defects in the amorphous structure form into shear transformation zone (STZ) by the site exchange through atomic diffusion of constituent elements, and then develop into the formation of shear bands through the connection between activated STZ. Therefore, through the elimination of the activated STZ occurring under repeated stress, the microstructure recovery and the resetting of the metallic glass can be attained. Conversely, when structural relaxation (SR) occurs in an unstable amorphous structure by the application of external energy, the local contraction behavior occurs, and thus through the dilatation of these contraction regions, the microstructure recovery and the resetting of the metallic glass can be attained. As such, the structural change in the metallic glass under the use environment may vary depending on the initial state of a specimen and the change pattern in the use environment, but as for the recovery behavior of a local defect region by the application of external energy in the metallic glass, the dense and loose structures are usually custom placed in different stress environments on the basis of the interdependency therebetween, and thus the recovery thereof can be attained by the same post-treatment. The relative amount of activated STZs (or SRs) in the amorphous structure may be checked by differential scanning calorimetry. Specifically, the activated STZs are generally known to have a high energy state, and thus when the amount of activated STZs in the amorphous matrix increases after repeated use, the gentle exothermic reaction curve becomes large at a low temperature not higher than the crystallization temperature and the size of the curve becomes reduced after the resetting process of healing detect regions, in the DSC synthesis.

TABLE 8

| | Resetting process conditions | | | | ΔH (J/mol) | | | |
|---|---|---|---|---|---|---|---|---|
| Classification | Minimum temperature (° C.) | Maximum temperature (° C.) | Number of repetitions | Retention time (s) | Energy (E) | Variation (ΔE) | Resetting rate ($\Delta E/\Delta E_c$ *100, %) | Note |
| Condition 1 | — | — | — | — | −100.3 | — | — | as-cast |
| Condition 2 | — | — | — | — | −5.8 | — | — | relaxed |
| Condition 3 | — | — | — | — | −408.5 | — | — | fatigued |
| Test conditions (resettable metallic glass - Example 16) | | | | | | | | |
| Condition 4 | −20 | 100 | 30 | 60 | −376.5 | 32.0 | 10.4% | — |
| Condition 5 | −50 | 100 | 30 | 60 | −222.7 | 185.8 | 60.3% | — |
| Condition 6 | −100 | 100 | 30 | 60 | −149.7 | 258.8 | 84.0% | — |
| Condition 7 | −200 | 100 | 30 | 60 | −130.6 | 277.9 | 90.2% | — |
| Condition 8 | −100 | 25 | 30 | 60 | −315.2 | 93.3 | 30.3% | — |

TABLE 8-continued

| Classification | Resetting process conditions: Minimum temperature (° C.) | Maximum temperature (° C.) | Number of repetitions | Retention time (s) | ΔH (J/mol): Energy (E) | Variation (ΔE) | Resetting rate ($\Delta E/\Delta E_c$ *100, %) | Note |
|---|---|---|---|---|---|---|---|---|
| Condition 9 | −100 | 150 | 30 | 60 | −135.6 | 272.9 | 88.5% | — |
| Condition 10 | −100 | 200 | 30 | 60 | −139.8 | 268.7 | 87.2% | — |
| Condition 11 | −100 | 100 | 1 | 60 | −374.7 | 33.8 | 11.0% | — |
| Condition 12 | −100 | 100 | 5 | 60 | −175.2 | 233.3 | 75.7% | — |
| Condition 13 | −100 | 100 | 100 | 60 | −137.6 | 270.9 | 87.9% | — |
| Condition 14 | −100 | 100 | 30 | 10 | −284.3 | 124.2 | 40.3% | — |
| Condition 15 | −100 | 100 | 30 | 20 | −153.9 | 254.6 | 82.6% | — |
| Condition 16 | −100 | 100 | 30 | 300 | −159.2 | 249.3 | 80.9% | — |
| Comparison conditions (typical metallic glass -Comparative Example 2, $Zr_{62}Cu_{38}$) | | | | | | | | |
| Condition 17 | — | | — | — | −321.8 | — | — | Comparative Example 2 (fatigued) |
| Condition 18 | −100 | 100 | 30 | 60 | −274.7 | 47.1 | 15.2% | Comparative Example 2 |

Figure 10:
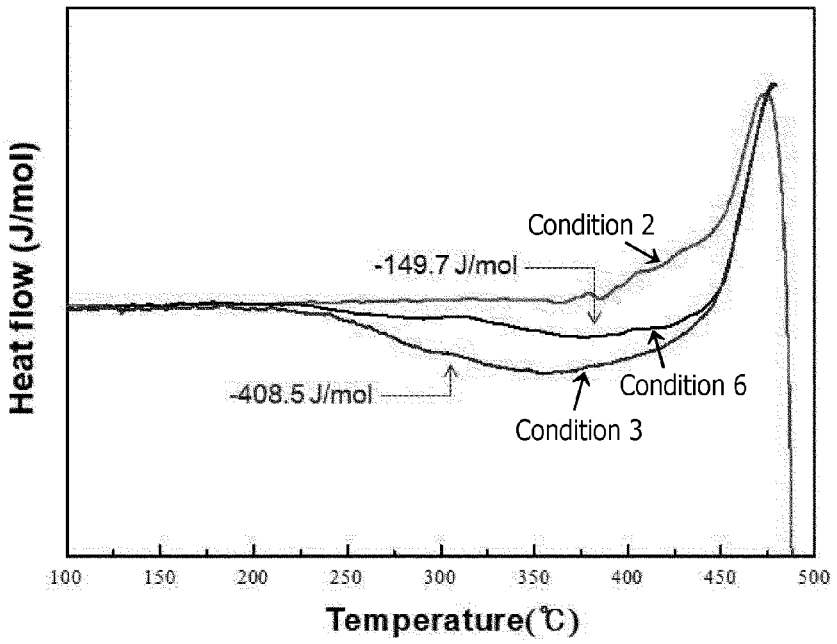
FIG. 10 shows the differential scanning calorimetry (DSC) results for specimens obtained by treating the composition of Example 16 with Condition 2, Condition 3, and Condition 6.

Condition 1 shows the results of DSC measurement immediately after Example 16 was manufactured. When such a metallic glass was heated at a temperature of 70% or more of the glass transition temperature, the STZ regions formed during the manufacturing of the metallic glass were decreased, and in the DSC analysis, the ΔH value of the energy region showing a gentle exothermic reaction at a low temperature not higher than the crystallization temperature was decreased. That is, the structure of the metallic glass could be estimated by confirming the change in ΔH value in this section. The ΔH value was obtained by calculating the exothermic peak area before the crystallization temperature on the DSC curve as shown in FIG. 10.

Specifically, when a specimen having the composition of Example 16 was measured, the ΔH value was about −100.3 J/mol as shown in Table 8. This energy may be determined to be caused by a liquid-like region necessarily occurring during the formation of an amorphous structure. However, when such a metallic glass was heated for 10 minutes at 350° C., which was about 0.8 times the glass transition temperature of the corresponding metallic glass, this value was very decreased to about −5.8 J/mol, approaching zero (FIG. 10, Condition 2). However, when such a material received stress in the use environment, ΔH increased with an increased amount of STZs. For verification thereof, in the present disclosure, specimens obtained from by subjecting the developed alloy to deformation within the critical deformation was post-treated under different resetting process conditions, and then a fatigue fracture test was performed. As a result, the STZ regions in the alloy increased with increasing number of fatigue test cycles, and in DSC analysis, the STZ region in the alloy increases, and in DSC analysis, ΔH of the energy region showing a gentle exothermic reaction at a low temperature not higher than the crystallization temperature was about 408.5 J/mol (after 50% deformation of the maximum fatigue deformation), indicating a large increase compared with the As-cast state (FIG. 10, Condition 3). These results indicate that the active utilization of the relaxation treatment is needed for effective control of resettability.

On the basis of Conditions 4 to 16 on Table 8, the resetting process conditions of the present disclosure were defined below. The resetting process was performed by repeatedly applying a low-temperature environment (minimum temperature) and a high-temperature environment (maximum temperature) to the material with maximized STZ region due to the concentration of fatigue stress for a predetermined time (retention time). The relative change of the STZ region was checked by the ΔH value, wherein the magnitude (variation, ΔE) of the value was evaluated based on the ΔH value in Condition 3.

First, as for Conditions 4 to 7, the results were investigated while the minimum temperature of the resetting process was changed. As shown in the table, the minimum temperature was −20° C., too high, and thus when sufficient energy cannot be applied to materials, ΔE was 32 J/mol. However, as the minimum temperature was lowered to −50° C. or more, the effect thereof was increased, showing a ΔE value of 185.8 J/mol or more. This value was 50% or more of 308.2 J/mol, which is ΔE between the as-cast alloy of Condition 1 and the fatigued alloy of Condition 3, indicating great resettability. Therefore, the minimum temperature as a process condition of the present disclosure is preferably −50° C. or lower. The difference of two energy values was not determined as 308.2 J/mol, and the characteristic value varies according to the alloy system or the degree of fatigue deformation. This standard value was denoted as $\Delta E_c$, and in the present disclosure, the ratio (percentage) of ΔE and $\Delta E_c$ generated during each process was defined as a resetting rate, and the value for each condition is shown in Table 8.

Then, as for Conditions 8 to 10, the results for changing the maximum temperature of the process were shown. Also from these results, the ΔE value was very small when the maximum temperature was too low, the room temperature level, and thus the treatment was preferably performed at a temperature of at least 100° C. However, when the resetting process is performed at a temperature of 0.7 or more of the glass transition temperature ($T_g$) determined according to the alloy, the structural relaxation may occur, resulting in the state as in Condition 2, and thus the resetting process is preferably performed at this temperature or lower.

Then, Conditions 11 to 13 shows the results of controlling the number of repetitions of the resetting process. The number of repetitions refers to the number of repetitions of one cycle in which an alloy prepared at room temperature was transferred once from a low-temperature condition to a high-temperature condition and then air-cooled to room temperature. Fewer than five repetitions showed little effect on resetting, and only at least five repetitions showed a value of 50% or more of $\Delta E_c$.

Last, Conditions 14 to 16 shows the results of controlling the retention time of the resetting process. The retention time had a less influence compared with other variables, but when the retention time was shorter than 20 seconds, the temperature stabilization through conduction was insufficient throughout the specimen, resulting in a large reduction in process efficiency. Therefore, the time for one time of resetting process is preferably limited to at least 20 seconds. When a metallic glass in a metastable phase was maintained at a high temperature for too long, undesirable structural relaxation behavior may occur or a crystalline phase may be formed. Therefore, it is not preferable to perform the process for 1 hour or longer.

Conditions 17 and 18 show the results of thermal analysis of a fatigue deformation region obtained after fatigue fracture of the metallic glass of Comparative Example 2 (Condition 17) and the specimen of Condition 17 combined with Condition 6, subjected to a resetting process (Condition 18). As can be seen from the results, in spite of the application of the resetting process (Condition 6) producing a resetting rate of 83% or more in the specimen of Example 16, the resetting was made at a resetting rate of 15.2%, a very low level, for the composition of Comparative Example 2.

It can be seen from these results that high-efficiency resetting behavior is not usually expressed in existing metallic glasses, but is restrictively possible in only the alloy systems of the present disclosure having multiple atomic-scale cluster resetting cores. In the present description, for experimental convenience, the resetting optimization process was limited to the alloy of Example 16 selected as a representative alloy, but the alloys of the present disclosure have similar amorphous structures having multiple atomic-scale cluster resetting cores, and thus it should be recognized that the above-described resetting occur in all the developed compositions in the present disclosure.

As shown in Table 10, even when the elements of the element group P or the element group N were alloyed in the alloying composition of the present disclosure, the resettability thereof was maintained or improved.

TABLE 10

| Classification Classification | Alloying composition: Matrix composition | Alloying element | Fraction (at. %) | Process condition: Process condition | ΔH (J/mol): Energy (E) | Variation (ΔE) | Resetting rate ($\Delta E/\Delta E_c$) |
|---|---|---|---|---|---|---|---|
| Condition 19 | Example 2 | Nb | 5 | Condition 6 | −147.02 | 261.48 | 84.8% |
| Condition 20 | Example 2 | Pd | 5 | Condition 6 | −151.13 | 257.37 | 83.5% |

Figure 11:
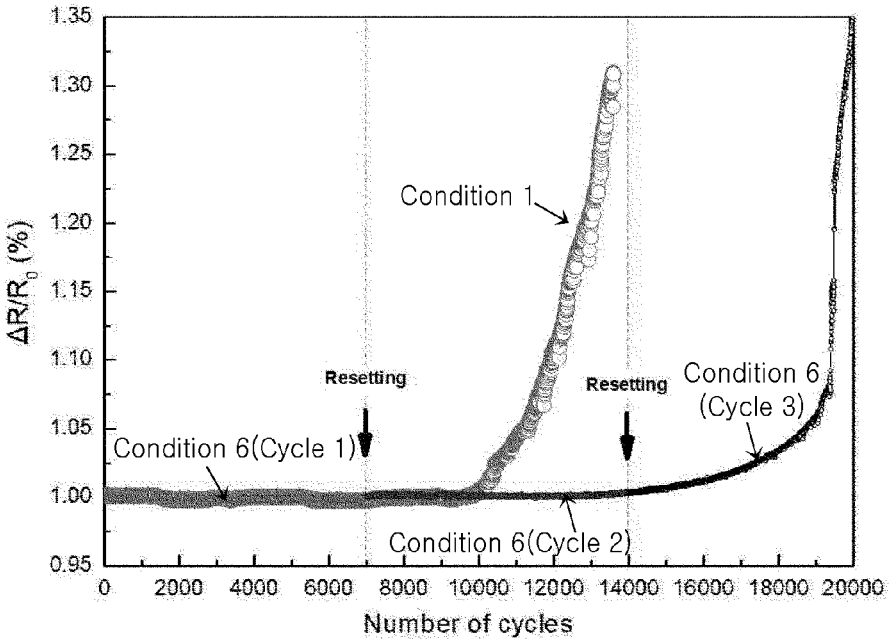
FIG. 11 shows the results of a fatigue test on the as-cast specimen (Condition 1) of the alloy of Example 16 of the present disclosure and the specimen obtained by performing a resetting treatment of Condition 6 on the alloy after 50% deformation of the maximum fatigue deformation.

FIG. 11 shows the results of a fatigue test on the as-cast specimen of the alloy of Example 16 of the present disclosure (Condition 1) and the specimen repeatedly subjected to the resetting treatment of Condition 6 after 50% of maximum fatigue cycle. The drawing shows that the resistance of materials changed according to the number of fatigue fracture cycles. The fatigue cracks are generated due to increased defects and gradually propagate, thereby increasing the electrical resistance of the materials. As can be seen from the drawing, the as-cast specimen of Example 16 (Condition 1) was fractured after undergoing about 14,000 cycles of fatigue stress. Especially, it can be identified that at about 10,500 cycles (=75% of the number of fracture cycles) or more, the electrical resistance was significantly increased through an abrupt increase in internal defects. Considering this matter, in the present disclosure, the corresponding alloy allowed to undergo up to 7,000 cycles of fatigue stress, which correspond to 50% of the number of fracture cycles (red), and then subjected to the resetting process of Condition 6. When such a developed metallic glass was repeatedly subjected to resetting treatment, the metallic glass was deformed by 20,000 cycles exceeding 14,000 cycles corresponding to the original lifespan of the material (blue). Therefore, by repeatedly performing the resetting process according to the present disclosure, the fatigued deformation region occurring in the material can be effectively eliminated, leading to long lifespan.

To optimize the properties of resettable metallic glasses as described above, a two-stage heat treatment may be performed on the manufactured alloy. The aforementioned two-stage heat treatment may include a relaxation treatment (hereinafter, RX-treatment) as a first stage and a resetting treatment (hereinafter RS-treatment) as a second stage, which are performed on the metallic glass manufactured by rapid cooling.

As for the relaxation treatment as the first stage, a soft spot that is essentially formed during solidification can be completely eliminated by performing the metallic glass to a heat treatment at a temperature not exceeding the glass transition temperature. Actually, as shown in FIG. 10 according to the present disclosure, when the alloy immediately after being manufactured (Condition 3) is subjected to heat treatment, all the energy existing therein disappeared as in Condition 2. Such a first-stage heat treatment may be performed by a heat treatment at a temperature lower than the glass transition temperature defined for each alloy composition and a heat treatment at a temperature of at least 70% of the glass transition temperature (0.7 $T_g$). When such a heat treatment is performed too long, crystallization may occur due to the metastability of the amorphous structure, and thus the heat treatment is advantageously performed for 60 minutes or shorter due to the possibility of crystallization or advantageously performed for 10 seconds or longer in consideration of heat transfer of materials.

To increase soft spots or maximize metastability inside the alloy subjected to the first-stage heat treatment, the alloy may be subjected to a resetting treatment as a second-stage heat treatment. The resetting treatment plays a role of increasing the inner energy of a material itself and can maximize the efficiency of a resetting process. Such a resetting treatment may be performed by a method including the application of mechanical deformation, thermo-cycle, electric energy, magnetic energy, and the like, at a level of avoiding material crystallization or fracture. The application of energy may increase the internal energy as shown in Conditions 3 and 6 in FIG. 10. Specifically, a thermo-cycling process is performed at least five times, in which an environment for the application of external energy at −50° C. or lower and an environment for the application of external energy at 100° C. or higher are alternately operated for at least 20 seconds. In addition, the application of external energy for such a two-stage treatment process may be performed by an external force including mechanical, electric, thermal, or magnetic energy at a level equivalent to the aforementioned thermo-cycling condition.

While the exemplary embodiments of the present disclosure have been described above, the embodiments are only examples of the present disclosure, and it will be understood by those skilled in the art that the present disclosure can be modified in various forms without departing from the technical spirit of the present disclosure. Therefore, the scope of the present disclosure should be determined on the basis of the descriptions in the appended claims, not any specific embodiment, and all equivalents thereof should belong to the scope of the present disclosure.

What is claimed is:

1. A resettable metallic glass represented by the chemical formula below:

$$\left[(TM)_{\frac{100-x}{100}}(E)_{\frac{x}{100}}\right]_{100-p-n}(PN)_p(NP)_n \qquad \text{(Chemical Formula)}$$

(TM is Hf;

E is an element group having a eutectic reaction with the TM;

PN is an element group having a positive (+) enthalpy of mixing with the TM and a negative (−) enthalpy of mixing with the E;

NP is an element group having a negative (−) enthalpy of mixing with the TM and a positive (+) enthalpy of mixing with the E, and A is at least one element group selected from the group consisting of P and N, wherein $15 \le x \le 66.6$, $0 < p \le 2$, $5 \le n \le 15$, $5 < p+n \le 17$, and =5 at. %.), wherein the E is Zn, wherein the PN is at least one species of element selected from the element group consisting of Sc, La, Pr, Sm, Dy, Ho, and Er, wherein the NP is at least one species of element selected from the element group consisting of B, V, Mn, Ga, In, Sn, Pb, and Bi, wherein the P is at least one species of element selected from the element group consisting of Mo, Ta and W, and, wherein the N is at least one species of element selected from the element group consisting of C, N, Si, P, Ge, Pd, Pt, and Au.

2. The resettable metallic glass of claim 1, wherein clusters by a short-range ordered structure or a repulsion between elements in an amorphous matrix form multiple resetting cores.

3. The resettable metallic glass of claim 1, wherein all of two or more crystallization behaviors occur when a glass matrix is crystallized.

4. The resettable metallic glass of claim 1, wherein a critical point of deformation that is resettable by performing a thermo-cycling process at least five times is 75% of the maximum fracture fatigue deformation, and wherein the thermo-cycling process includes alternate application of external energy at −50° C. or lower and external energy at 100° C. or higher for at least 20 seconds.

5. The resettable metallic glass of claim 1, wherein a resetting after performing a thermo-cycling process at least five times is 50% or more of $\Delta E_c$, and wherein the thermo-cycling process includes alternate application of external energy at −50° C. or lower and external energy at 100° C. or higher for at least 20 seconds, ($\Delta E_c$ is a difference between a ΔH value of the metallic glass immediately after being manufactured and a ΔH value measured at the level of 50% of the maximum number of fatigue fracture cycles).

* * * * *